US006381871B2

(12) United States Patent
Uehara

(10) Patent No.: US 6,381,871 B2
(45) Date of Patent: May 7, 2002

(54) METHOD AND APPARATUS FOR DRYING WOOD

(75) Inventor: Taira Uehara, Osaka (JP)

(73) Assignee: Wood Drying Research Association, Tokyo (JP)

( * ) Notice: Subject to any disclaimer, the term of this patent is extended or adjusted under 35 U.S.C. 154(b) by 0 days.

(21) Appl. No.: 09/775,832

(22) Filed: Feb. 5, 2001

(30) Foreign Application Priority Data

Feb. 4, 2000 (JP) ..... 2000-028435
May 17, 2000 (JP) ..... 2000-145565

(51) Int. Cl.[7] ..... F26B 3/00
(52) U.S. Cl. ..... 34/446; 34/445
(58) Field of Search ..... 34/446, 403, 474, 34/77, 411, 537, 475, 417, 493

(56) References Cited

U.S. PATENT DOCUMENTS 1,593,890 A * 7/1926 Welch ..... 236/44 R
3,131,034 A * 4/1964 Marsh ..... 34/191
3,744,144 A * 7/1973 Weis ..... 34/403
4,176,464 A * 12/1979 Randolph ..... 34/191
4,356,641 A * 11/1982 Rosenau ..... 34/191
5,325,604 A * 7/1994 Little ..... 34/493
5,940,984 A * 8/1999 Moren ..... 34/396
6,119,364 A * 9/2000 Elder ..... 34/212

FOREIGN PATENT DOCUMENTS

JP 06-257946 9/1994

OTHER PUBLICATIONS

T. Yoshida et al., "High Temperature Drying of Boxed Heart Lumber of Japan Cedar", Abstracts of the 49th Annual Meeting of the Japan Wood Research Society, Apr. 2–4, 1999, Tokyo, Japan.

* cited by examiner

*Primary Examiner*—Joseph Pelham
*Assistant Examiner*—Vinod D. Patel
(74) *Attorney, Agent, or Firm*—Young & Thompson

(57) ABSTRACT

A method of drying wood comprises the step of drying wood in a drying chamber at a controlled temperature and a controlled humidity. The temperature and the moisture content inside the wood while being dried are monitored continuously or intermittently, and the temperature and the humidity in the drying chamber are controlled based on the resulting data.

6 Claims, 2 Drawing Sheets

Drying History Graph

METHOD AND APPARATUS FOR DRYING WOOD

BACKGROUND OF THE INVENTION

This invention relates to a method and an apparatus for drying wood which are particularly suited for boxed heart lumber (lumber with heart center), which is used in houses as pillars, etc.

For use as a constructional material as pillars, etc., wood must be dried to reduce its moisture content to a certain level to prevent deformation or cracking on shrinkage. In particular, constructional wood recently tends to be supplied in pre-cut or pre-worked form, and dried wood with higher dimensional stability and less susceptibility to cracking has been demanded.

A wood drying method comprising softening wood by initial steaming at 95° C. for 8 hours followed by drying at a dry-bulb temperature of 120° C. and a wet-bulb temperature of 90° C. for 72 hours has been proposed as a technique for achieving drying in a short time while suppressing cracking on the surface (surface checks) (see Abstract of the 49th Convention of The Japan Society of Wood).

When the proposed method was applied to boxed heart lumber of Japan cedar (11.5 mm×1.5 mm×3000 mm), however, all of 70 test pieces of the wood suffered from cracks in the internal portion, and darkening (scorching associated with high-temperature drying) of the wood color was observed. We heretofore have no drying method and apparatus that satisfy the requirements: (1) causing no surface checks, (2) suppressing darkening, and (3) causing no internal cracks. It has therefore been keenly demanded to develop a method and an apparatus satisfying all these requirements.

SUMMARY OF THE INVENTION

An object of the present invention is to provide a method and an apparatus for drying wood which suppress surface checks, internal cracks, and darkening of wood.

The above object of the present invention is accomplished by a method of drying wood comprising drying wood in a drying chamber at a controlled temperature and a controlled humidity, wherein the temperature and the moisture content inside the wood while dried are monitored continuously or intermittently, and the temperature and the humidity in the drying chamber are controlled based on the resulting data.

The object of the invention is also accomplished by an apparatus having a drying chamber in which wood is to be placed and dried and of which the temperature and the humidity are controllable, which is equipped with a means for measuring the temperature inside the wood while dried and a means for measuring the moisture content inside the wood while dried.

BRIEF DESCRIPTION OF THE DRAWINGS

The present invention will be more particularly described with reference to the accompanying drawings, in which.

DETAILED DESCRIPTION OF THE PREFERRED EMBODIMENTS

In carrying out the wood drying method of the present invention, a drying apparatus equipped with a drying chamber whose temperature and humidity are controllable is used.

An example of the drying apparatus which is used preferably to carry out the method of the invention will be illustrated with reference to FIG. 1.

Figure 1:
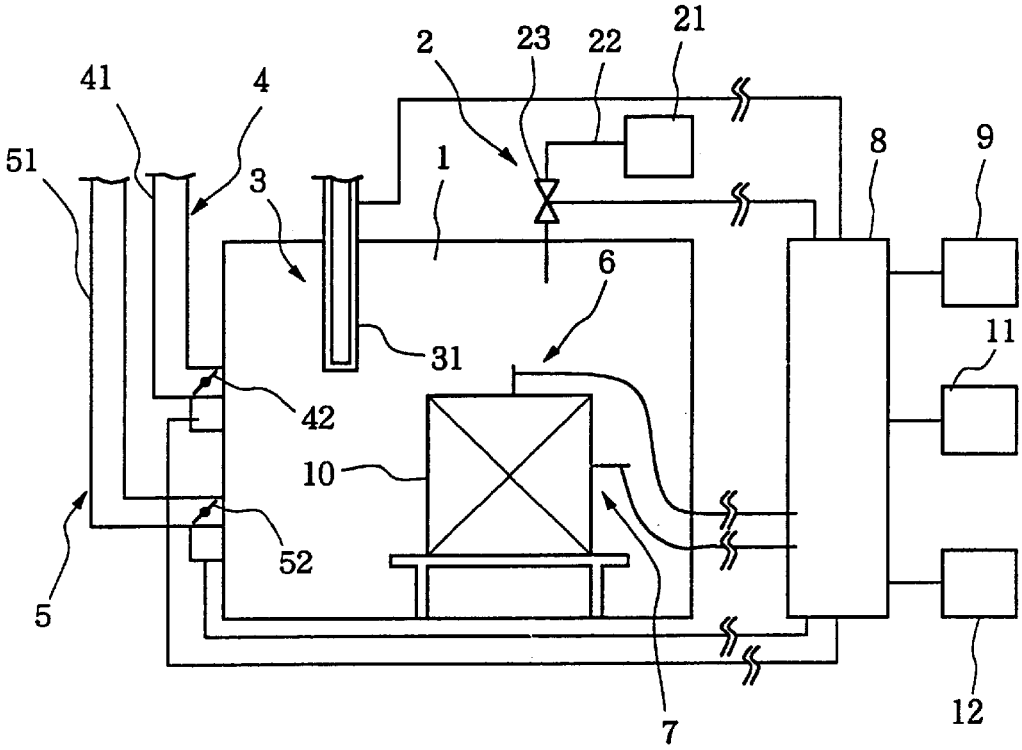
FIG. 1 schematically illustrates an example of the drying apparatus according to the present invention.

Having a drying chamber 1 whose temperature and humidity are controllable, the drying apparatus shown in FIG. 1 can dry wood contained in the drying chamber 1 under the control of temperature and humidity of the drying chamber 1.

In more detail, the drying apparatus shown in FIG. 1 comprises a drying chamber 1 in which wood 10 to be dried is placed, a steam injector 2 which injects steam into the drying chamber 1, a heater 3 for heating the air inside the drying chamber 1, an air feeder 4 for introducing open air into the drying chamber 1, and an exhauster 5 for discharging the air in the drying chamber 1.

The steam injector 2 is designed to introduce steam from a steam generator 21 (e.g., a steam boiler) into the drying chamber 1 through a steam pipe 22 connected to the chamber 1. Steam injection is controllable with a control valve 23, such as an electromagnetic valve or an electrically-operated valve, provided on the steam pipe 22.

The heater 3 has a heating pipe 31 disposed within the drying chamber 1, in which a heating medium (steam) is made to flow to heat the air in the drying chamber 1. The heating is controlled by controlling the flow, the flow rate, the temperature, etc. of the heating medium.

The air feeder 4 and the exhauster 5 have respective ducts 41 and 51 which connect the inside and the outside of the drying chamber 1 and respective fans (not shown) which induce an air flow in the respective ducts. Air feed or discharge can be controlled by means of the fans and dampers 42 and 52 provided on the respective ducts.

The temperature and the humidity in the drying chamber 1 can be controlled as desired by appropriately controlling steam injection by the steam injector 2, heating by the heater 3, air feed by the air feeder 4, and air discharge by the exhauster 5.

The wood drying apparatus according to the present invention is equipped with a means 6 for measuring the temperature inside the wood while being dried and a means 7 for measuring the moisture content inside the wood while dried.

The temperature measuring means 6 and the moisture content measuring means 7 of the apparatus of this embodimet are designed to make the respective measurements at two or more points in the wood different in depth from the wood surface.

Figure 2:
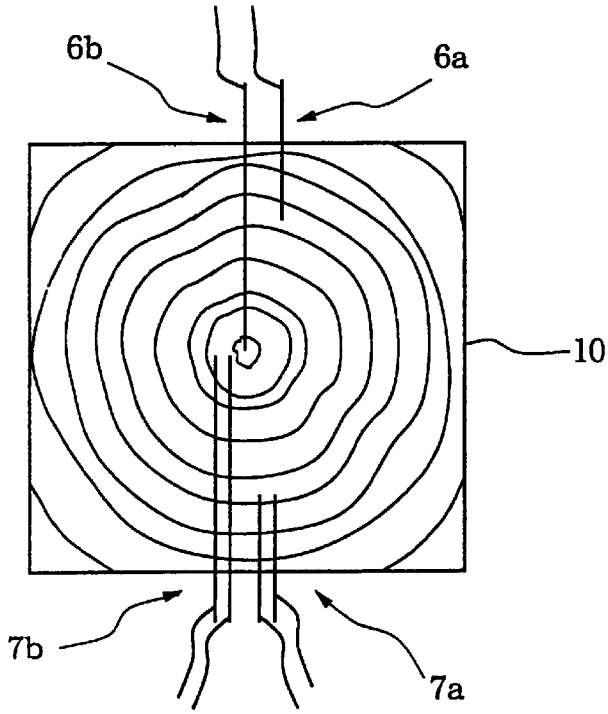
FIG. 2 schematically shows means of measurement embedded into lumber.

The temperature measuring means 6 includes a plurality of temperature sensors 6*a* and 6*b* each having a thermocouple as shown in FIG. 2. Each temperature sensor 6*a* or 6*b* is inserted into a hole pierced in wood so as to measure the inside temperature. More specifically, holes having a diameter enough for the thermocouple and a depth reaching a temperature measuring point are made in wood with a drill, etc., and a thermocouple is inserted into the hole so that the probe (contact point) may reach the measuring point. The opening of the hole around the inserted thermocouple is sealed with a heat insulator, e.g., non-asbestos Neoseal (TM) available from Nippon Kasei Chemical Co., Ltd.

The moisture content measuring means 7 includes a plurality of moisture content sensors 7*a* and 7*b* each having a pair of rod elements. The pair of rod elements, which are connected to the respective leads via the respective clips, are driven vertically in wood toward the center with a prescribed gap therebetween, and the resistance between the two rods is measured. The change in resistance is input in a control operation part 8 hereinafter described. The pair of rod elements are preferably made of stainless steel for its resistance to oxidation or corrosion. For example, stainless steel nails can be used as the rod elements.

The plurality of the temperature sensors 6*a* and 6*b* can reach different depths from the wood surface. So can the plurality of the moisture content sensors 7*a* and 7*b*.

The temperature sensors 6*a* and 6*b* and the moisture content sensors 7*a* and 7*b* are electrically connected to the control operation part 8 which is mainly composed of a computer, where prescribed computations are carried out to obtain the internal temperatures and moisture contents of the wood. In this embodiment, the output data are continuously displayed on a display 9 and/or printed out from a printer 11, so that an operator may give instructions through an input means 12 based on the output data to change the temperature and the humidity in the drying chamber 1.

A preferred embodiment of the wood drying method of the present invention by use of the above-mentioned apparatus is described below.

Wood 10 to be dried is placed in the drying chamber 1. Usually, several to several hundred pieces of lumber are stacked with spacing between them and treated at a time. The temperature sensors 6*a* and 6*b* and the moisture content sensors 7*a* and 7*b* are set at prescribed positions of at least one piece of wood to be monitored. In this embodiment the measurement of the temperature and the moisture content is made at two depths from the wood surface, i.e., a depth of about a quarter of the lumber thickness and a depth of about a half of the lumber thickness as shown in FIG. 2. That is, one of the temperature sensors 6*a* and one of the moisture content sensors 7*a* are set with their sensing tips in the middle between the surface and the center of the wood (hereinafter referred to as a middle portion) to measure the temperature and the moisture content in the middle portion, while the other temperature sensor 6*b* and the other moisture content sensor 7*b* are set with their sensing tips in the central portion of the wood to measure the temperature and the moisture content in that portion.

After making these necessary preparations, steam from the steam injector 2 is introduced into the drying chamber 1 to perform initial steaming on the wood 1. The initial steaming is a step for softening the wood to be dried to improve drying efficiency in the subsequent high-temperature drying step. The initial steaming is preferably carried out at 95° C. for about 6 to 10 hours.

On completion of the initial steaming, the drying chamber temperature is quickly raised to 110° C. or higher while the inside of the wood is in a softened state to commence drying. The method according to the preferred embodiment has a first step of drying at a dry-bulb temperature of 110° C. or higher and a second step of drying at a dry-bulb temperature lower than that of the first step.

The first step, which is a drying step following the initial steaming step, is preferably carried out at a dry-bulb temperature of 115 to 125° C., particularly around 120° C., and a wet-bulb temperature of 80 to 95° C., particularly around 90° C.

During the first step, the temperature and the moisture content of the wood are measured at at least a point in the middle portion either continuously or intermittently. In the initial stage of the first drying step, only the temperature in the middle portion is monitored. When it exceeds 100° C., monitoring the moisture content in the middle portion is started. Then the dry-bulb temperature or both the dry-bulb and the wet-bulb temperatures in the drying chamber 1 is/are reduced at the indication that the moisture content in the middle portion is reduced to a prescribed level (preferably about 35% which is a fiber saturation point). In other words, a switch from the first step to the second step is made taking the change in moisture content in the middle portion of the wood as an informative guide.

Where a switch from the first to the second steps is made based on the information on temperature and moisture content in the inside of wood, internal cracks of the wood can be suppressed effectively. Switching to the second step (drying at a lower dry-bulb temperature) at the point when the moisture content in the middle portion decreases to about 35%, the fiber saturation point of wood, or immediately before that time point is particularly effective to prevent internal cracks from happening. If such a switch is not made, and the drying is continued under the same conditions as in the first step, the surface of lumber is permanently "set" causing "case hardening". It follows that the internal pressure of the wood increases under heating at 110° C. or higher, and the internal moisture migrates toward the surface. Since the middle portion of the wood approaches the fiber saturation point with the decreasing moisture content, and the surface region has been set, the wood tends to undergo shrinkage due to abrupt drying, resulting in internal cracks (honeycombs).

Not only the moisture content but the temperature inside the wood furnish information for making a judgment on the moisture content's reduction below a prescribed value, which will compensate for the inaccuracy of the moisture content sensor. That is, the information of both the moisture content and the temperature ensures proper timing for making a switch.

In drying boxed heart lumber by a high-temperature drying method, it is preferred for shortening a drying time that the temperature inside wood be in a boiling state by keeping the internal temperature as high as possible after the moisture content reaches the fiber saturation point. In this connection, the method of the present invention is advantageous because the wood temperature can always be monitored by continuous or intermittent measurement.

The second drying step is preferably carried out at a dry-bulb temperature of 105 to 115° C., particularly around 110° C., and a wet-bulb temperature of 75 to 85° C., particularly around 80° C.

The term "continuously or intermittently" as used with respect to measurement of temperature and moisture content of wood means that the measurement does not always need to be "continuous" in the narrow sense of the word as long as the data furnished give information as to the time point when the wood internal temperature exceeds a prescribed temperature (e.g., 100° C.) and the time point when the wood internal moisture content decreases below a prescribed level (e.g., 35%).

The above-described embodiment further has a third step in which drying is performed at a still lower dry-bulb temperature than in the second step. During the second step, the temperature and the moisture content of the wood are measured at at least the central portion either continuously or intermittently. In the initial stage of the second step drying, only the temperature in the central portion is monitored. When it exceeds 100° C., monitoring the moisture content in the central portion is started. Then the dry-bulb temperature or both the dry-bulb and the wet-bulb temperatures in the drying chamber 1 is/are reduced taking reduction of the moisture content in the central portion to a prescribed value (preferably about 35%, a fiber saturation point) as an informative guide.

By further reducing the drying temperature with the change in moisture content in the central portion of the wood being taken as an informative guide in this way, internal cracks and color darkening due to high-temperature drying can be suppressed more effectively. Being based on the information about both the temperature and the moisture content inside the wood, the switch from the second to third steps can be made with timing that is the most effective for reduction of drying time and prevention of cracks. As compared with monitoring only the moisture content, monitoring both the temperature and the moisture content facilitates right timing as with the switch from the first to the second steps.

The above-described preferred embodiment of the drying method produces the following effects. (1) Surface checks of wood can be reduced. (2) Color darkening of wood can be suppressed. (3) Internal cracks of wood can be remarkably reduced. (4) The drying time can be shortened to reduce the cost of drying. (5) The drying schedule is simple, causing few failures. (6) The dried wood has stable final quality.

The drying chamber 1 which can be used in the present invention is not structurally limited, and any type of drying chambers can be employed as far as it is capable of containing wood and drying the wood under controlled temperature and controlled humidity. The constructions of the steam injector 2, the heater 3, the air feeder 4, and the exhauster 5, and the means for measuring the temperature and the moisture content in the inside of wood are not limited to those described above, and any known constructions can be used as are consistent with the intended functions.

It is preferred for the apparatus according to the present invention be equipped with a control operation part for automatically controlling the temperature and the humidity in the drying chamber based on the temperature and moisture content data so that the above-described preferred embodiment of the drying method of the invention may be carried out automatically. This can be embodied by programming the computer for this work.

The present invention will now be illustrated in greater detail with reference to Example.

EXAMPLE

Fifty pieces of boxed heart lumber (113×113×3000 mm) of Japanese cedar were dried in a drying apparatus having the structure of FIG. 1 under the following schedule. The green moisture content (the moisture content before drying) of the wood was 77.9%.

| Drying Schedule: | |
|---|---|
| Initial steaming: | 95° C. × 8 hrs |
| First drying step: | dry-bulb temperature of 120° C. and a wet-bulb temperature of 90° C. |
| Second drying step: | dry-bulb temperature of 110° C. and a wet-bulb temperature of 80° C. |
| Third drying step: | dry-bulb temperature of 105° C. and a wet-bulb temperature of 80° C. |

In the initial stage of the first drying step only the temperature in the middle portion of a piece of the lumber was monitored. When the temperature exceeded 100° C., monitoring the moisture content in the middle portion started. At the time point (P1) when the moisture content decreased to about 35%, which is the fiber saturation point of the wood, the dry-bulb and wet-bulb temperature conditions in the drying chamber were changed to those of the second step. In the initial stage of the second step only the temperature in the central portion was monitored. When that temperature exceeded 100° C., monitoring the moisture content in the central portion started. At the time point (P2) when the moisture content in the central portion decreased to 35%, the dry-bulb and wet-bulb temperature conditions were changed to those of the third step.

Figure 3:
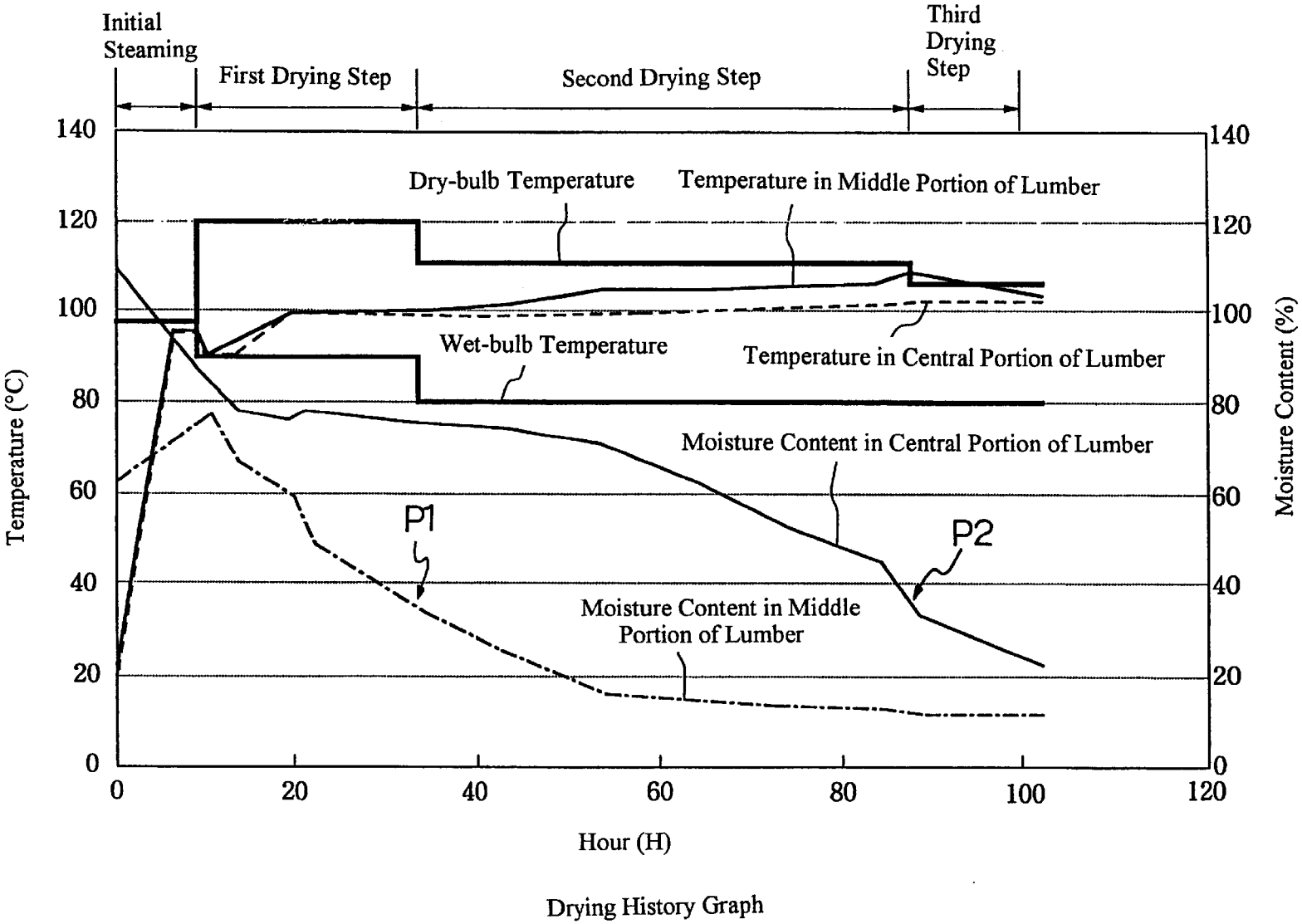
FIG. 3 is a drying history graph showing changes in temperature and moisture content of lumber and the process control conducted in Example.

FIG. 3 is a drying history graph showing changes in temperature and moisture content of the lumber and the process control. The time periods of the first, second and third drying steps were 22 hours, 60 hours and 12 hours, respectively. The total treating time from the commencement of initial steaming up to the completion of the third drying step was 102 hours.

COMPARATIVE EXAMPLE

Fifty pieces of boxed heart lumber (111×111×3000 mm) of Japanese cedar were dried in the same apparatus as used in Example under the following schedule. The green moisture content of the wood was 86.1%.

| Drying Schedule: | |
|---|---|
| Initial steaming: | 95° C. × 8 hrs |
| Drying: | dry-bulb temperature of 120° C. and a wet-bulb temperature of 90° C. |

The drying step was carried out while keeping the dry-bulb temperature and the wet-bulb temperature constant, making no change in temperature and humidity. The total treating time from the commencement of the initial steaming up to the completion of the drying was 81 hours.

Evaluation:

The dried lumber obtained in Example and Comparative Example (50 pieces each) was evaluated in terms of moisture content, surface checks and internal cracks in accordance with the following methods. The results are shown in Table 1.

1) Moisture Content

A 30 mm wide sample was cut out of the central portion of the dried lumber and weighed (W1; g). Then, the oven dry weight (W2; g) of the sample was obtained in accordance with JIS Z2101 (Methods of test for woods). That is, the sample was placed in an oven and heated at temperature of 105° C. until a constant weight was reached, and the oven dry weight was weighed. The moisture content (%) after drying is calculated from (W1−W2)/W2×100.

2) Surface Checks 2-1)

The number of pieces of lumber out of 50 which developed a surface check having a width of 0.5 mm or more at its widest and a length of 200 mm or more was counted.

2-2)

The number of surface checks each having a width of 0.5 mm or more at its widest and a length of 200 mm or more was counted for every piece of lumber. The counted number was multiplied by the surface check area (100 $mm^2$) to obtain the total surface check area per piece. Table 1 shows the average surface check area of 50 pieces of lumber.

3) Internal Cracks (End Checks)

The butt ends of every piece of lumber (100 (50×2) but ends in total) were observed. The degree of internal cracking was graded on the following 1-to-4 scale, and the percentage of the butt ends graded at each scale was obtained.

1 No end checks developed.

2 An end check having a width of 1 mm or less at its widest and a length of 20 mm or less developed.

3 An end check having a width of 2 mm or less at its widest and a length of 50 mm or less developed.

4 An end check having larger dimensions developed.

TABLE 1

| | | Example | Comparative Example |
|---|---|---|---|
| Moisture Content after Drying (%) | | 13.7 | 10.6 |
| Number of Lumber Items having Surface Check(s) | | 10/50 | 14/50 |
| Total Surface Check Area ($mm^2$)/item | | 337 | 342 |
| Occurrence (%) of End Checks | 1 | 53 | 0 |
| | 2 | 27 | 33 |
| | 3 | 13 | 40 |
| | 4 | 7 | 27 |

It is seen from the results in Table 1 that the method of this invention is remarkably effective to reduce internal cracking as compared with the conventional method (Comparative Example). Further, the degree of darkening of the dried wood obtained by the method of Example was lower than that observed with the dried wood of Comparative Example. The method of the present invention is particularly effective in drying wood to a moisture content of 30% or less, especially 20% or less.

The present invention provides a method and an apparatus for drying wood while appreciably suppressing drying defects such as surface checks, color darkening, and internal cracks.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A method of drying wood, comprising the steps of:

drying wood in a drying chamber at a controlled temperature and a controlled humidity;

either continuously or intermittently measuring the temperature inside the wood while being dried;

either continuously or intermittently measuring the moisture content inside the wood while being dried; and controlling the temperature and humidity in the drying chamber based on the thus-measured temperature and moisture content inside the wood.

2. The method according to claim 1, wherein the drying step comprises a first step of drying at a dry-bulb temperature of 110° C. or higher and a second step of drying at a dry-bulb temperature lower than that of said first step, wherein a switch from said first step to said second step being made based on the thus-measured temperature and moisture content inside the wood.

3. The method according to claim 1, wherein the steps of measuring the temperature and the moisture content inside the wood are measured at two or more points different in depth from the wood surface.

4. Wood drying apparatus, comprising:

a drying chamber in which wood is to be placed and dried;

means for measuring the temperature inside the wood while being dried in said chamber;

means for measuring the moisture content inside the wood while being dried in said chamber; and means for controlling the temperature and humidity in the chamber on the basis of the thus-measured temperature and humidity inside the wood.

5. The wood drying apparatus according to claim 4, wherein said means for measuring the temperature and said means for measuring the moisture content are capable of making the respective measurements at two or more points different in depth from the wood surface.

6. The wood drying apparatus according to claim 4, wherein said drying chamber is designed to have its temperature and humidity automatically controlled based on the thus-measured temperature and moisture content inside the wood obtained with said means for measuring the temperature and said means for measuring the moisture content.

* * * * *